United States Patent [19]

White

[11] 3,995,706

[45] Dec. 7, 1976

[54] EARTH AUGER DRILL

[75] Inventor: Kenneth M. White, Calgary, Canada

[73] Assignee: Western Rock Bit Company Limited, Canada

[22] Filed: June 23, 1975

[21] Appl. No.: 589,077

[30] Foreign Application Priority Data

Feb. 27, 1975 Canada ..... 220881

[52] U.S. Cl. ..... 175/392; 175/394; 175/397

[51] Int. Cl.[2] ..... E21B 9/22

[58] Field of Search ..... 175/390, 391, 392, 394, 175/404, 405, 397, 398

[56] References Cited

UNITED STATES PATENTS

| | | | |
|---|---|---|---|
| 715,657 | 12/1902 | Griffiths | 175/394 |
| 1,961,390 | 6/1934 | Ragsdale | 175/404 X |
| 2,736,542 | 2/1956 | Cartlidge | 175/397 X |
| 2,749,104 | 6/1956 | Barrett | 175/398 X |
| 2,776,123 | 1/1957 | Snyder | 175/398 X |
| 3,074,703 | 1/1963 | Adams et al. | 175/404 X |
| 3,095,053 | 6/1963 | Pistole et al. | 175/404 X |
| 3,175,630 | 3/1965 | Hein et al. | 175/394 X |
| 3,235,018 | 2/1966 | Troeppl | 175/398 X |

*Primary Examiner*—Ernest R. Purser
*Assistant Examiner*—Richard E. Favreau
*Attorney, Agent, or Firm*—Wenderoth, Lind & Ponack

[57] ABSTRACT

A drill of the type comprising a pilot point for locating the drill in a medium to be drilled and cutting means extending from the pilot point and having a radially outermost portion which defines the radius of the hole to be drilled and which precedes a radially inner portion into the medium both axially and radially to promote fracture of the medium laterally of the direction of drilling and thereby to facilitate drill penetration into the medium.

4 Claims, 12 Drawing Figures

EARTH AUGER DRILL

BACKGROUND OF THE INVENTION

Hole drilling by the auger method is a commonly utilized means of providing mounting holes for everything from fence posts to building pilings. Conventional augers in use today are somewhat limited in the types of formations that they can drill. This invention offers improvements in conventional auger design such that harder and more varied formation types can be drilled by the auger method.

SUMMARY OF THE INVENTION

In general, drills according to the invention may be defined as comprising a pilot point for locating the drill in a medium to be drilled and cutting means extending from the pilot point and having a radially outermost portion which defines the radius of the hole to be drilled and which precedes a radially inner portion into the medium both axially and radially to undercut the medium and promote fracture thereof laterally of the direction of drilling whereby to facilitate drill penetration into the medium.

The utilization of the undercutting principal is best achieved, in a more practical definition of the invention, by utilizing cutting teeth that are so arranged that as the radial distance from the centerline or axis of the auger drill increases, the depth that the cutting teeth work at increases. Furthermore, within structural limitations, as the radial distance from the centerline of the auger increases the cutting teeth in radially subsequent rows preceed those in the adjacent radially inner row. This variation of design allows drilling in particularly hard layered formations, such as shale. Another inherent feature of utilizing this configuration of auger is the stability of the auger in the hole being drilled. Since the outer or gage tooth cuts deeper and preceeds the inner tooth rows, an angular groove is formed in the formation which stabilizes the auger and prevents side thrusting and "bottom walking" as is common with conventional augers. A further advantage of utilizing this particular auger drill configuration is the reverse curved bottom hole profile that is ready for concrete fill at the completion of drilling. Utilizing conventional step-up auger drills requires a secondary operation to produce a flat bottomed hole such that the concrete pile will not be pointed when it is poured and set.

BRIEF DESCRIPTION OF DRAWINGS

A more detailed description follows with reference to FIGS. 1 through 9. In the drawings.

DESCRIPTION OF PREFERRED EMBODIMENT

Figure 1:
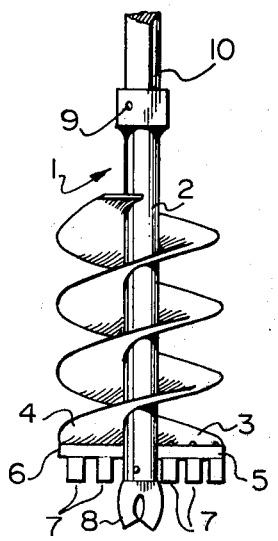
FIG. 1 (PRIOR ART)
- FIG. 1 shows a conventional double helix auger.

The conventional auger assembly 1 shown in FIG. 1 is of the twin helix, flat bottom type and consists of central power transmission stem 2, twin helical auger flighting for removing pick-up 3, 4, tooth mounting bars 5, 6, digger teeth 7, and pilot point 8. The auger assembly 1 is generally attached by pin 9 to the square drive kelly 10. Downward weight applied to the drive kelly causes the pilot point and teeth to penetrate the formation F. The teeth when the auger is rotated remove a segment of the formation that is being drilled, which is picked up by the helical auger flighting. Guidance of the auger head during drilling depends upon the pilot point and the circumferential grooves G cut by the teeth, since the tooth holder bars are generally straight. This method of keeping the auger from "walking" on the bottom or drilling out of position is satisfactory only if the formation has sufficient strength to retain a straight-walled pilot hole H. If the formation is soft, as for example non-consolidated sand, the auger will tend under certain circumstances to drill off to one side.

Figure 2:
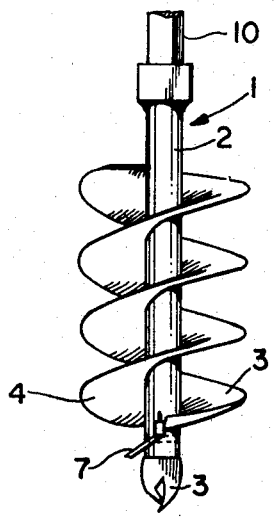
FIG. 2 (PRIOR ART)
- FIG. 2 is a side view of the auger shown in FIG. 1.

An auger assembly according to FIGS. 1 and 2 generally requires a high powered drilling machine for operation. Since all teeth come into contact with the formation simultaneously, there is no tendency to fail the formation in lateral shear.

Figure 3:
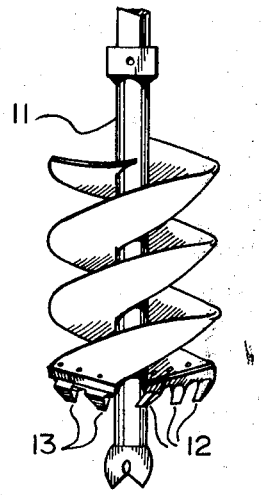
FIG. 3 (PRIOR ART)
- FIG. 3 shows a conventional step-up auger.
Figure 4:
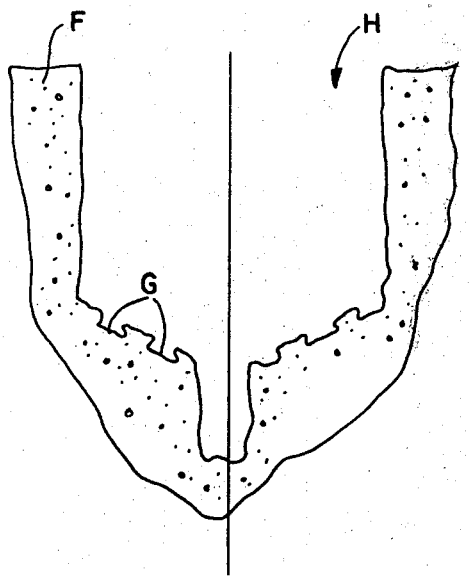
FIG. 4 (PRIOR ART)
- FIG. 4 is a schematic of the bottom hole pattern generated by the auger of FIG. 3.

The auger assembly 11 of FIG. 3 has similar components to that of FIG. 1, the major difference being that the teeth do not cut across a flat face. In augers of this type, the teeth 12, generally cut at different depths and angles from teeth 13, still maintain a predominately pointed hole bottom pattern as illustrated by FIG. 4. An auger assembly according to FIG. 3 has very little tendency to "walk" on bottom due to the angle of the base of the hole combined with the downward weight applied to the auger.

The drilling torque curve for an auger assembly according to FIG. 3 is at a minimum when the drill is initially starting and increases progressively until all the teeth are in contact with the formation. The torque required then is substantially constant and depends on the formation hardness. Even though this particular type of auger design has more formation in contact with the cutter teeth than the auger shown in FIG. 1, the cutting torque is less due to the utilization of the lesser lateral shear strength of the formation.

Figure 5:
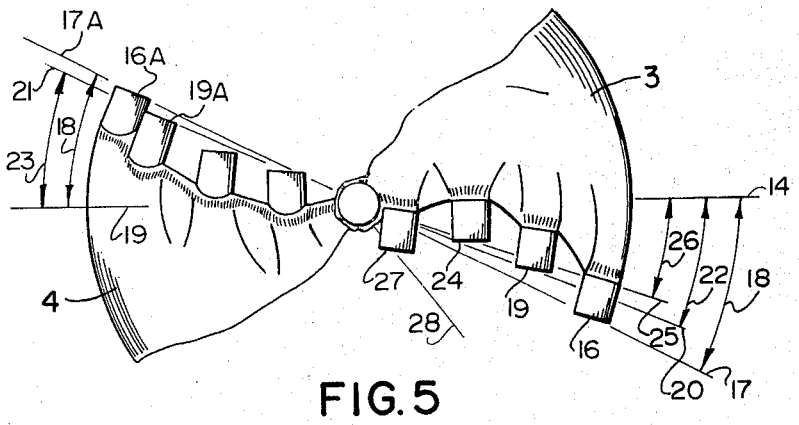
- FIG. 5 is a top view of the preferred auger according to the invention.
Figure 6:
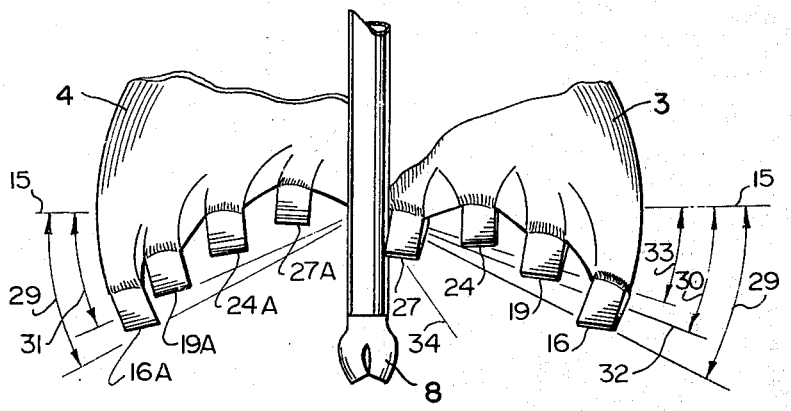
- FIG. 6 is a front elevation of the auger of FIG. 5.
Figure 7:
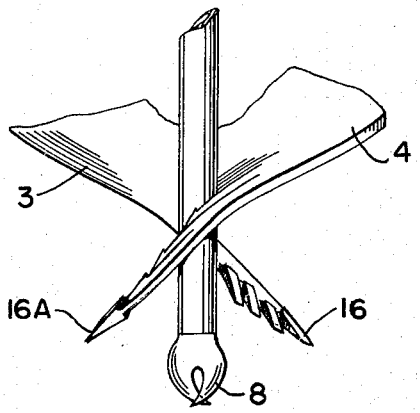
- FIG. 7 is a side elevation of the auger of FIG. 5.

The auger configuration that embodies the present invention is shown in FIGS. 5, 6 and 7. As defined briefly above, FIG. 5 is a top view as would be seen if the helical auger flighting were removed. FIG. 6 is a frontal view taken along a convenient radial line 14 as per FIG. 5, and FIG. 7 is a side view looking into the auger along line 15.

Gage cutter teeth 16 and 16A have their ends on line 17, 17A which is as an angle 18 with radial line 14. It is preferred that the gage cutter teeth be at the same angle 18 on each side of the auger drill in order to distribute the cutting load evenly. Secondary cutter teeth 19, 19A have their ends on radial lines 20 and 21 respectively. Angle 22 of line 20 as shown is not equal to angle 23 of line 21 and satisfactory performance can be maintained. Cutter tooth 24 has its end on line 25 forming angle 26 with radial line 14. Cutter tooth 27 has its end on radial line 28 which forms an angle greater than angle 18 on the gage cutter tooth. This is not the preferred method of maintaining the undercutting action desired of the present auger drill but structural requirements dictate the tooth angle near the main power transmission stem.

Referring to FIG. 6, the ends of gage cutter teeth 16, 16A lie on a line at an angle 29 with the horizontal radial line 15. It is preferred that the angle 29 of the gage cutters be equal on each side of the auger drill. The ends of cutter teeth 19 and 19A lie on lines at angles 30 and 31 respectively with respect to radial line 15. Tooth 24 has its end on radial line 32, forming angle 33 with the radial line 15. Cutter tooth 27 has its end on line 34 which forms an angle greater than angle 29 for the gage cutter. This is due only to structural requirements generally for the tooth mounting holders. It is possible on larger diameter augers to have the cutter angle nearest the auger drill stem less than angle 29.

The preferred auger configuration shown in FIGS. 5 and 6 is distinctive in that the gage or outermost teeth precede the inner tooth rows into the formation being drilled. The gage teeth precede the inner row teeth both in cutting depth and in a radial sense such that when the inner rows of teeth are in contact with the formation there is a circumferential groove cut at gage and a hole drilled by the pilot point.

Figure 8:
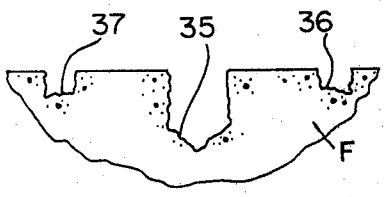
- FIGS. 8–8C is a progressive schematic of the bottom hole pattern generated by the auger embodying the invention during drilling.
Figure 8A:
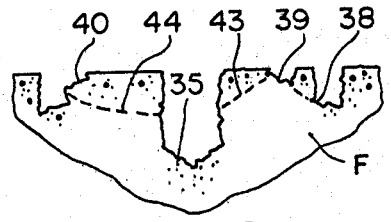
Figure 8B:
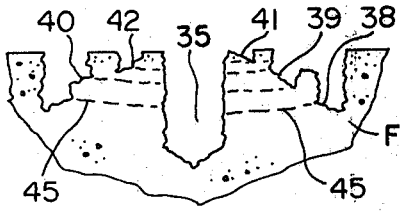
Figure 8C:
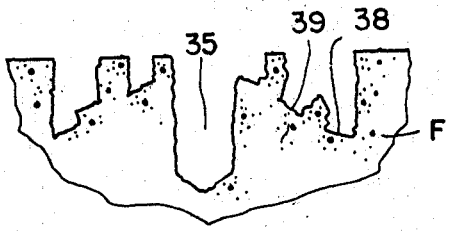

The progressive schematic in FIGS. 8–8C shows the drilling pattern generated by the preferred auger at the start of the hole drilling operation. In FIG. 8, the pilot point has penetrated at 35 and the right and left gage cutters at 36 and 37 respectively. In FIG. 8A, a circumferential groove has been formed by the gage cutters at 38 and inner row teeth 39 and 40 are beginning to penetrate. In FIG. 8B, the groove 38 is deeper as are the grooves cut by teeth on rows 39 and 40, and teeth at 41 and 42 are just beginning to penetrate. In FIG. 8C, all teeth are in contact with the formation and the schematic is shown as if the auger has not made one complete revolution. To illustrate the fracture lines in the formation caused by the inner rows of teeth, in FIG. 8A formation failure occurs according to dotted lines 43 and 44. In FIG. 8B failure can occur across the dotted lines 45 as shown. It can be seen by the failure mode of the formation in FIGS. 8A and 8B that the annular groove at 38 exposes a larger area of formation to failure than the flat bottomed or pointed type of auger. It can also be seen that if the formation fails along line 45—45 in FIG. 8B the drilling cycle as illustrated in FIG. 8 is repeated. This is particularly important in hard layered formations such as shales. In these formations, due to their relatively high compressive strength, every attempt should be made to maximize the area of formation failed but minimize the tooth contact with the formation.

Figure 9:
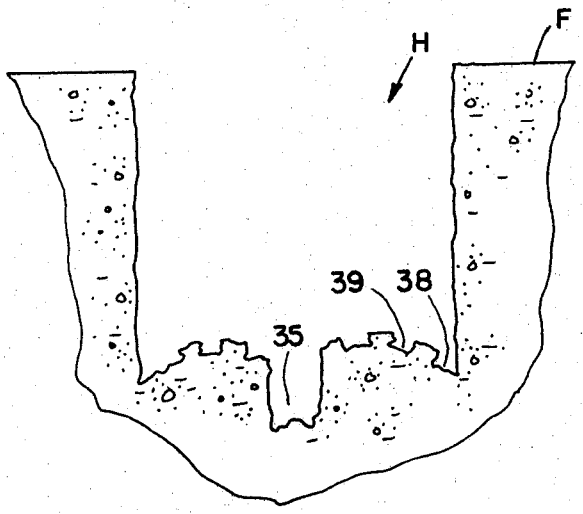
- FIG. 9 is a schematic of the completed bottom hole pattern generated by the auger embodying the invention.

FIG. 9 is a schematic of the final bottom hole pattern generated by the preferred auger configuration. It is noted that the objectionable pointed hole bottom is not present.

What I claim as my invention is:

1. An auger type drill comprising at least two helical auger flights, a pilot point projecting from the drilling end of the auger flights centrally of the drill, and a plurality of teeth on the drilling ends of each of the auger flights, each of said teeth projecting at an angle downwardly and in the direction of rotation of the drill for drilling, the outermost tooth in each plurality being at the peripheral edge of the corresponding auger flight which defines the radius of the hole to be drilled by the drill and being at a level with respect to the pilot point which is above the pilot point with respect to drilling in the downward direction, the next adjacent tooth in each plurality being above the level of the outermost tooth and circumferentially rearwardly, with respect to the direction of rotation of the drill during drilling, of a radial reference line on which the tip of the outermost tooth lies, and the innermost tooth in each plurality being above the level of the outermost tooth and having the tip thereof positioned no further circumferentially rearwardly with respect to the outermost tooth than said radial reference line.

2. An auger type drill as claimed in claim 1 in which said radially innermost tooth in each plurality extends circumferentially forwardly of said radial reference line.

3. An auger type drill as claimed in claim 1 in which corresponding teeth in each set other than the innermost teeth are at the same radial distance from the pilot tip.

4. An auger type drill as claimed in claim 1 in which at least some of the corresponding teeth in each set are at different radial distances from the pilot tip.

* * * * *